United States Patent [19]

McGee

[11] 4,031,823

[45] June 28, 1977

[54] SCREEN PRINTER WITH ADJUSTABLE SCREEN SUPPORT AND MAGNETIC SQUEEGEE MEANS

[76] Inventor: George S. McGee, 2311 E. 28th St., Chattanooga, Tenn. 37407

[22] Filed: May 23, 1975

[21] Appl. No.: 580,408

Related U.S. Application Data

[63] Continuation of Ser. No. 391,980, Aug. 27, 1973, abandoned.

[52] U.S. Cl. ..... 101/120; 68/256; 100/DIG. 17; 101/115; 101/126; 101/128.1; 335/306

[51] Int. Cl.² ..... B41F 15/44; B41F 15/38

[58] Field of Search ..... 101/115, 116, 119, 120, 101/121, 122, 123, 124, 126, 127.1, 128.1, 181, 248, 157, 169; 15/256.5, 256.51; 335/295, 306; 8/149; 68/200, 256; 100/168, DIG. 17

[56] References Cited

UNITED STATES PATENTS

| | | | |
|---|---|---|---|
| 2,309,914 | 2/1943 | Montague | 101/115 |
| 3,151,400 | 10/1964 | Schmitt | 101/127.1 X |
| 3,231,789 | 1/1966 | Engelsted | 335/295 |
| 3,572,240 | 3/1971 | Bohm | 101/116 |
| 3,588,768 | 6/1971 | Baermann | 335/306 X |
| 3,592,132 | 7/1971 | Weber | 101/119 |
| 3,675,571 | 7/1972 | Vertegaal | 101/115 |

FOREIGN PATENTS OR APPLICATIONS

| | | | |
|---|---|---|---|
| 2,046,467 | 1/1972 | Germany | 101/115 |
| 478,667 | 11/1969 | Switzerland | 101/120 |

*Primary Examiner*—Edgar S. Burr
*Assistant Examiner*—R. E. Suter
*Attorney, Agent, or Firm*—Patrick F. Henry

[57] ABSTRACT

A carpet or fabric screen printer has a plurality of size-adjustable screen printing rolls mounted on repositionable heads on a long frame for the purpose of repeating a pattern in different colors. Each printing head comprises a screen printing roll on which is mounted the screen and inside of which is mounted a roller of magnetically attracted material or having a magnet unit having both North and South poles along the length thereof. The magnetic roller rolls when the head is in operation but remains in one position with respect to the screen printing roll. A continuous conveyor belt delivers the fabric sheet beneath the screen and the roller inside the screen roll. A second magnetic roller on the head beneath the conveyor belt and on the other side of the conveyor belt from the screen and the second roller also has North and South poles which are attracted by corresponding opposite poles on the first roller. Each head is mounted on side rails for selective adjustment and relocation thereon by means of adjustment dials on the head so that the distance between the heads may be changed to vary the repetition of the patterns. Each head also has other adjustments for positions horizontally and laterally with respect to the rails.

14 Claims, 9 Drawing Figures

SCREEN PRINTER WITH ADJUSTABLE SCREEN SUPPORT AND MAGNETIC SQUEEGEE MEANS

This is a continuation of application Ser. No. 391,980 filed 8-27-73 now abandoned.

BACKGROUND OF THE INVENTION

1. Field of the Invention

Screen printing machinery for textiles. Magnetically attracted roller devices for padding, dyeing and the like of textiles.

2. Description of the Prior Art

One known prior art patent is the George S. McGee U.S. Pat. No. 3,407,415 which discloses magnetically attracted rollers in a padding arrangement for squeezing dye solutions out of continuously delivered fabric sheets. No screen process or arrangement is disclosed in this patent and multiple heads for dyeing do not enter into the purpose of the invention. The usual screen printing machines employ a plurality of screen printing heads which like the present invention are mounted on a frame over a continuous conveyor belt which conveys the continuous fabric to be printed. The conventional screen printing machines require considerable mechanical changes and rearrangements to change from one size screen or pattern repeat to another size screen or pattern repeat and a great deal of time to accomplish this. Also, while magnetic rollers and belts have been employed in screen printing devices for the purpose of creating more pressure between a belt and a roller such an arrangement does not include the method of applying adjustable pressure for forcing the dyestuff through the screen into the goods by the use of magnetic rolls on opposite sides of the fabric or the adjustment of pressure through the use of opposite magnetic poles being attracted to one another.

SUMMARY OF THE INVENTION

An object of this invention is to provide a multiple screen rotary screen printer arrangement that has the flexibility of being able to change from screen of one diameter pattern (repeat) to another in a short period of time and to physically move the rotary screen printer heads towards or away from each other to change the composite pattern which is made up of the totality of the pattern repeats of each of the screens.

The arrangement described in the previous paragraph may include a means of applying adjustable pressure for forcing dyestuff into the goods through the use of magnetic rolls having opposite poles and also the desired pressure may be adjusted and obtained by lateral adjustment of one set of poles on one roller with respect to the other.

Another object of this invention is to provide a method of applying adjustable pressure to force the dyestuff through the screen.

Another feature of the present invention is found in the use of magnetic rolls on opposite sides of the fabric being printed and the adjustment of opposite poles on the magnetic rolls.

Still another advantage in the present invention is found in the location of one of the (magnetic) rolls inside the screen and inside the screen roll in contact with the outside of the screen roll to help force the dyestuff through the screen into the fabric goods.

DESCRIPTION OF A PREFERRED EMBODIMENT & METHOD

Figure 1:
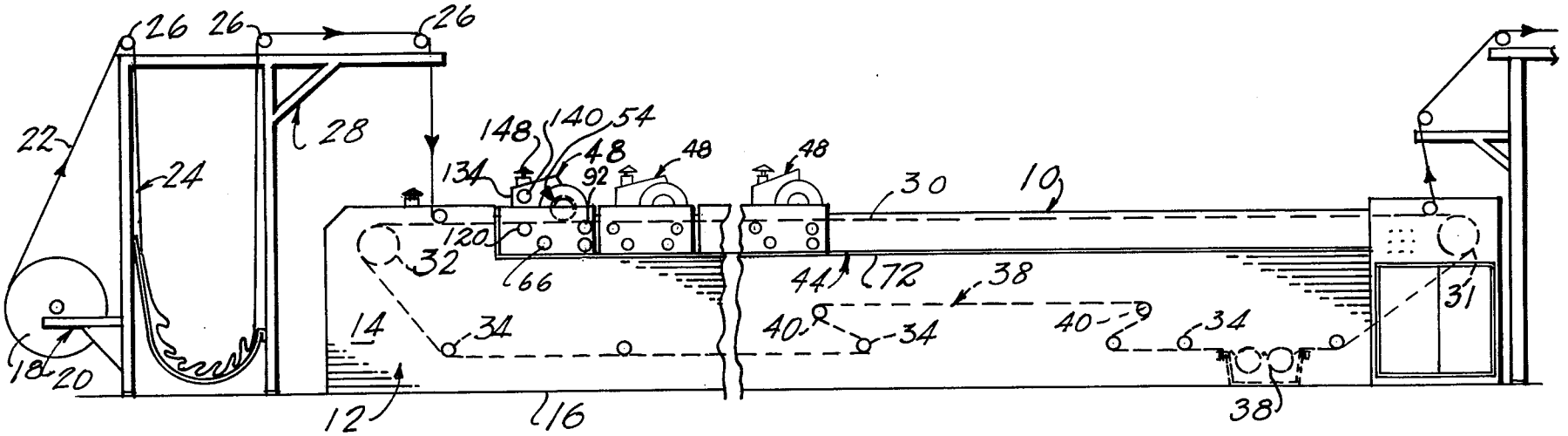
FIG. 1 is a side elevation view of a multi-station rotary screen printer having a plurality of adjustable heads.

In FIG. 1 there is shown a multiple-station rotary screen printer designated generally by reference numeral 10 and comprising a machine frame designated generally by reference numeral 12 which is for the most part covered by metal plate 14 and extends in a longitudinal direction along the floor 16. Fabric to be printed is delivered in rolls 18 mounted on a roll support mechanism 20 and the fabric 22 is conveyed in a continuous web or sheet into any conventional scray 24 across rollers 26 and a scray support frame designated generally by reference numeral 28 into the machine 10 and onto a continuous conveyor belt 30 driven by a main drive roller 31 and a main belt conveyor roller 32 and smaller rollers 34 in more or less conventional fashion as found in most rotary screen printers. The conveyor belt 30 travels across a conveyor belt washer arrangement 38 employing adjustable rollers 40 for the purpose of adjusting any stretch or slack in the belt and for otherwise adjusting the feed and travel of the belt 30.

Figure 8:
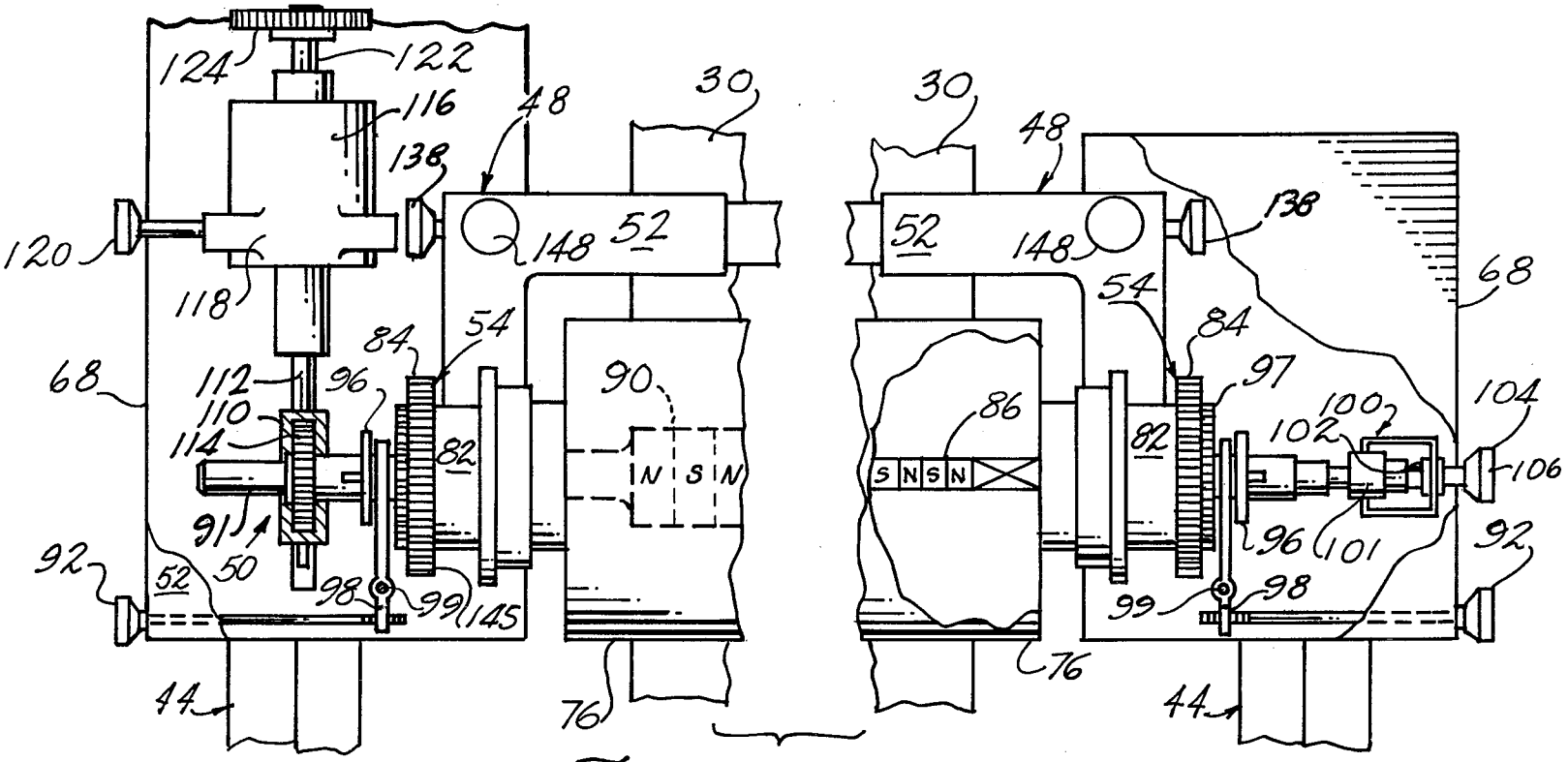
FIG. 8 is a top plan view of the station or head shown in FIGS. 4 and 5 with portions broken away showing the lower magnetic roller with the magnets marked.
Figure 9:
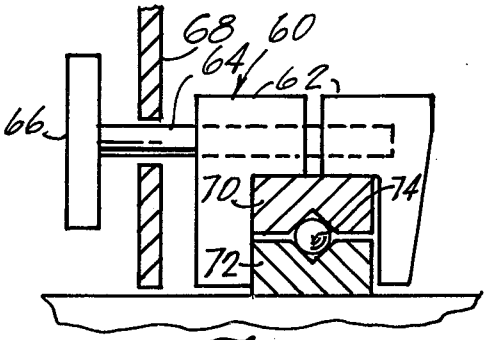
FIG. 9 is an enlarged elevation of the position lock for the housing of the station or head.

Mounted on opposite sides of the top of the machine frame 12 is a pair of large side track and rail assemblies 44 or head support (only one shown in FIG. 1) having rolls on opposite sides and each supporting a rotary screen head designated generally at 48 which is one of several and which is driven by a power shaft assembly 50 in a housing 52 in which there is a drive arrangement assembly 54 (FIG. 8). Each head housing 52 is supported on a track and rail assembly 44 on a position lock and travel arrangement 60 comprising a pair of frame clamp members 62 threadedly connected by means of adjustment shaft 64 operated by adjustment wheel position lock 66 thru the housing side 68. Clamping members 62 clamp a top block or rail 70 (FIG. 9) spaced from a bottom rack rail 72 by means of a ball bearing 74 whereby when the clamps 62 are loosened by the adjustment wheel 66 the top block 70 on which housing 52 is mounted will slide on the ball bearing 74. There is an arrangement of clamp 60 on both sides of the head 48 on each respective top rail 44.

Figures 4, 5, 6, 7:
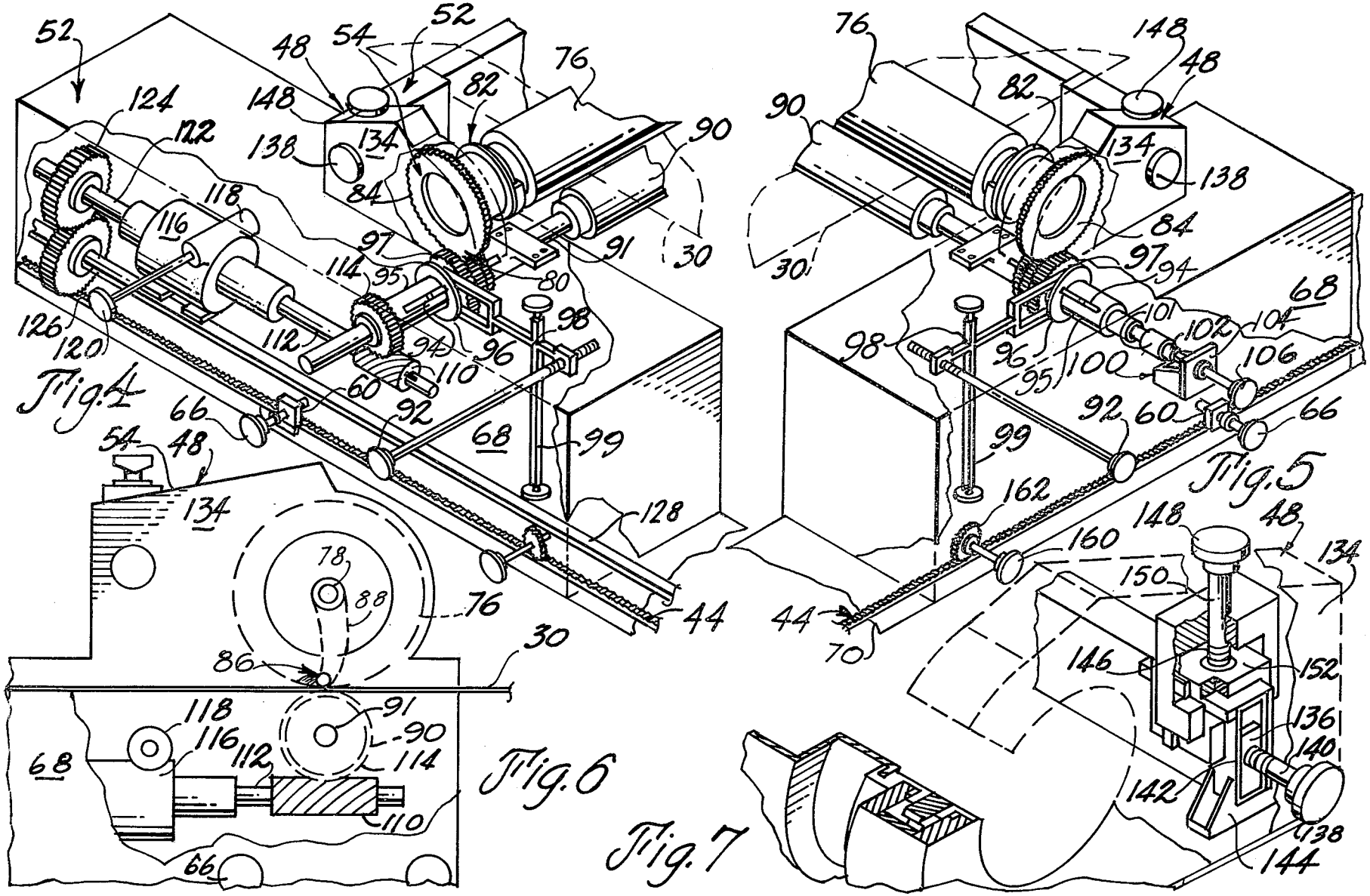
FIG. 4 is a perspective view of a portion of one side of the top of the printer showing the drive and other parts of one station or head.
FIG. 5 is a perspective view of a portion of the other side of the station or head from FIG. 4 showing details thereof.
FIG. 6 is a side elevation view of the head shown in FIGS. 4 and 5 with portions broken away.
FIG. 7 is an enlarged perspective of the housing for one end of the roller in FIGS. 4 and 5.

Each head 48 comprises a conventional screen print roller 76 mounted on a bearing and shaft assembly 78 and being driven through a gear and clutch assembly or arrangement 80 (FIG. 4). Each roller 76 may be changed and another larger or smaller diameter roller of a given diameter or pattern repeat substituted. Roller 76 has a bearing assembly 82 and a gear 84 on each end. Inside of each roller 76 there is mounted a magnetized roller 86 having both North and South poles spaced along the length thereof side-by-side in alternate arrangement and being held in position by a guide means 88. Roller 86 may be a non-magnetized magnetically attracted roller (e.g. iron-Fe.). The head 48 and housing 52 along with their related elements make up what may be termed the printer head assembly.

Mounted on the frame 12 beneath the conveyor belt 30 and on each of the respective heads 48 (FIG. 6) there is a second magnetic roller 90 which has both North and South poles across the length thereof alternating from one to the other. Shaft 91 is slotted at 94 and carries a collar 95 having a shifter disc 96 and a set of gears in an arrangement 97 (FIG. 4) of different sizes to match with gears on the various rollers 76 when changed from one diameter or pattern repeat to another. A shifting fork 98 pivots on a shaft 99 supported in housing 52. Since it is necessary to change the screen drive when screen size is changed the gear arrangement 97 is mounted on shaft 91 for lateral adjustment by means of a shifter disc 96 shifting on fork 98 by pivots on shaft 99 and operated by shifter control lever 92. The same arrangement is found on the other end of shaft 91 of roller 90, however, the end of the shaft 91 in FIG. 4 has a shaft 91 and roller 90 shifter 100 thereon (not to be confused with the gear 97 shifter 92) comprising a rotary thrust connector 101 attached to a shaft 102 operating in a block 104 on housing side 68. Block 104 prevents a control handle 106 and shaft 102 from lateral motion while allowing roll 90 to be moved laterally and transversely beneath roller 76. The shifting fork 98 is found on the other side of the machine shown in FIG. 5 comprising a pivot shaft 99 supported in the housing 52. Each of the shifting forks 98 is operated by the respective control 92 which is pushed or pulled depending upon which one of the gears 97 is to be shifted into position engaged with the gear 84 on roller 76.

Figure 3:
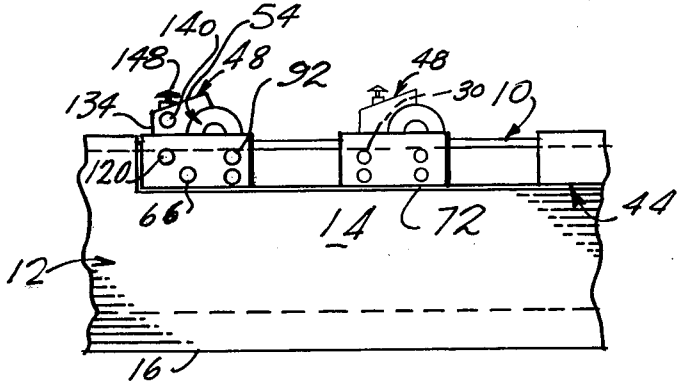
FIG. 3 is an elevation view of a portion of the printer in FIG. 1 with the heads adjusted further apart which would form a different composite pattern.
Figure 2:
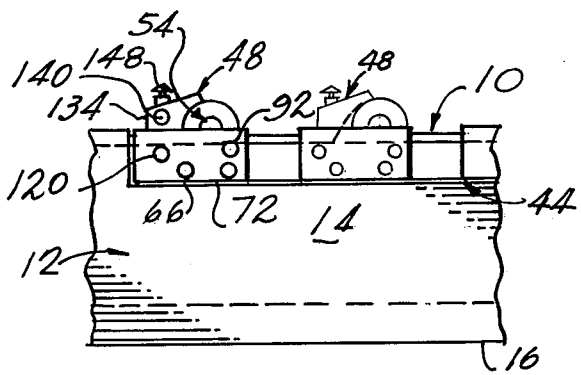
FIG. 2 is an elevation view of a portion of the printer in FIG. 1 with the heads closer together which would form one composite pattern.

Roller 90 and shaft 91 are driven by means of a worm gear 110 on a drive shaft 112 engaged with a drive gear 114 on shaft 91. Shaft 112 is rotated through a phase shifter or phase shifting differential (the particular one in use is a "SPECON" brand) 116 on which there is a control housing 118 operated by a control 120 to adjust the phase or syncronization of rollers 90 and 76 with respect to the rollers (printing screens) located at the other positions as shown in FIGS. 1,—2 and 3. The input shaft 122 to the phase shifter 116 is driven by drive gear 124 which is driven from one gear 126 of several and there being one at each particular repeat location on a shaft 128 which is turned from a power source such as an electric motor (not shown).

The ends of roller 76 at the bearing assembly 82 is mounted in a housing 134 which is part of the screen head 48 and which comprises a horizontal adjustment mechanism 136 having a horizontal adjustment control 138 which operates a threaded shaft 140 releasing a pressure block 142 carried in a screen adjustment housing support rail 144 which extends across the machine and is mounted to the housing 68 on both sides of the machine. There is also a vertical adjustment slide 146 comprising a vertical screen adjustment control 148 having a threaded shaft 150 operating a pressure block 152 for the purpose of adjusting the screen roll 76 vertically. Controls 144 and 148 are used to achieve correct and fine alignment and adjustment of the screen roll 76 with respect to the other rolls 76 located at the other roll stations. A position lock 66 locks the housing 68 into a desired position as discussed above. The housing 52 which includes the panel 68 is movable from one position to another as mentioned to vary the composite pattern and is accomplished by operating the control 160 which includes a small gear 162 riding in the teeth of the rail 44. There are three screen head driving gears 97, one for each pattern repeat or diameter screen. The particular size gear desired is shifted by moving the control 92 to mesh with the gear 84 according to the pattern repeat (diameter screen) being used. Even though only three gears are shown more or less could be used. The track assembly 44 supports and conveys the entire screen head 48 including the housing 52 and all of the parts supported thereon to the desired position and the position control 160 also acts as a horizontal aligning control for registering one screen with another. Operation of the control shifter 100, which acts as a roll position control means, changes the position of the roll 90 and therefore changes the relationship of the magnets in roll 90 with respect to the magnetic roller or non-magnetized magnetically attracted roller 86 inside (screen) roll 76 in relation to attraction or repulsion of magnetic force desired thereby obtaining more or less pressure as required and selected. This provides a selective control to attract roller 90 to the roller 86 in an adjustable manner which can be easily adjusted and changed by means of the operation of control 104. Rail 72 and pinion gear 162 are operated by control 160 to move the housing 52 which is mounted on rail 70 on the ball bearings 74 in rail 72 which is fastened to frame 12 and runs down each side of the machine.

While I have shown and described a particular embodiment of this invention with reference to a preferred construction this is by way of illustration only and does not constitute any sort of limitation on the scope of the invention since various alterations, changes, deviations, eliminations, revisions, additions, omissions, combinations and departures may be made from the embodiment shown without departing from the scope of my invention as defined only by a proper interpretation of the appended Claims.

I claim:

1. In a variable pressure device for applying pressure to a continuously moving material: an elongated magnetic roller having both North and South magnetic poles along the length thereof, an elongated magnetic member extending coextensively with said elongated magnetic roller and having both North and South magnetic poles along the length thereof, said North and South poles on the magnetic roller being located in opposed relation with the North and South magnetic poles on the magnetic member and within sufficient distance whereby the magnetic forces on the magnetic roller are affected by the magnetic forces on the magnetic member, said magnetic roller and said magnetic member being selectively relatively movable coextensively along respective longitudinal axes so as to vary magnetic attraction therebetween by selectively placing opposite magnetic poles in closer alignment to increase pressure between said magnetic roller and said magnetic member or to decrease the pressure between said magnetic roller and said magnetic member by placing like magnetic poles in closer alignment, whereby the pressure between said magnetic roller and said magnetic member may be selectively varied by means of relative motion therebetween.

2. The device in claim 1 wherein there is a printing screen and said magnetic roller is located inside said screen, said printing screen being between said magnetic roller and said magnetic member to receive pressure adjustment therefrom, said continuously moving material passing between said magnetic roller and said magnetic member, said printing screen being in contact with said material to print thereon, whereby the printing pressure may be adjusted.

3. The device in claim 2 wherein said magnetic member is a second roller.

4. In a screen printing device for printing on a continuously conveyed material: a screen printing head comprising a screen printing roll having a printing screen thereon and there being a first magnetic means contacting said printing screen for applying variable pressure against one side of the material and comprising both North and South magnetic poles along the length thereof, a second magnetic means spaced from and extending coextensively with said first magnetic means on the other side of the material for varying the pressure therewith by use of North and South magnetic poles located thereon, said first and second magnetic means being relatively movable coextensively and transversely of the frame with respect to said screen so as to provide variably magnetic attraction by selectively placing opposite magnetic poles in closer alignment to increase the pressure between said first and second magnetic means or selectively to decrease the pressure between said first and second magnetic means by placing the like magnetic poles in alignment.

5. A screen printing device according to claim 4 wherein the second magnetic means is mounted on a shaft, a plurality of gears on said shaft for selectively driving a screen, a driven gear on the first magnetic means, and means for shifting the shaft so that the gear on the first magnetic means is selectively engaged with one of the gears on the shaft.

6. A multiple head rotary screen printer according to claim 5 wherein there is a drive means for said shaft, and a phase shifter for said drive means for adjusting and synchronizing the phase when changing from a screen of one size to a screen of a different size.

7. The device in claim 4 wherein said first magnetic means is a roller mounted inside said screen and said second magnetic means is an elongated member extending coextensively with said roller outside said screen and on the other side of the material therefrom.

8. A multi-head rotary screen printer for printing on continuously conveyed material a succession of repeated lengths of a composite pattern created by the total of a succession of lengths of individual pattern repeats printed in succession on the material as it advances from one pattern repeat to the next until the composite pattern is achieved and wherein the length of the composite pattern can be changed by changing the distance between the pattern repeats:

an elongated frame having conveyor means thereon for conveying a continuous length of material to receive the composite pattern printed thereon, opposed sides on the top of the elongate frame each comprising an elongated head support on each side of said frame, a plurality of printer head assemblies each having two ends and having screen printing means thereon for screen printing each of said pattern repeats and;

means for changing the length of said composite pattern comprising means for adjustably mounting each of said ends of said assemblies on the respective head support, means for selectively locking each of said printer head assemblies in selected positions on said head supports and means for selectively driving said screen printing means in each of said selected positions, whereby each of said printer head assemblies may be repositioned with respect to the other printer head assemblies longitudinally of the frame either in the direction of or opposite to the direction of movement of the material to adjust the distance between head assemblies and thereby change the composite pattern.

9. A multi-head rotary screen printer according to claim 8, wherein each screen printing means comprises a screen printing roll and a second roll, each head assembly comprising a support housing at each of said ends, each of said housings being mounted on the respective opposed sides said adjustable mounting and locking means being located between the respective support housing and side to position and lock each support housing in said selected positions on the elongated frame.

10. A multi-head rotary screen printer according to claim 9 wherein the second roll is mounted on a shaft, a plurality of gears on said shaft, a driven gear on the printing roll, and means for shifting the second roll shaft so that the gear on the printing roll is selectively engaged with one of the gears on the shaft.

11. A multi-head rotary screen printer according to claim 8 wherein said means for selectively driving comprises a phase shifter for adjusting and synchronizing the phase of the particular screen in use when changing from a screen of one diameter or pattern repeat to another of different diameter or pattern repeat.

12. A multi-head rotary screen printer according to claim 8, wherein each screen printing means comprises a screen printer roll having a printing screen thereon and there being a first magnetic means contacting said printing screen for applying variable pressure against one side of the material and comprising both North and South magnetic poles along the length thereof, a second magnetic means spaced from and extending coextensively with said first magnetic means on the other side of the material for varying the pressure therewith by use of North and South magnetic poles located thereon, said first and second magnetic means being relatively movable coextensively and transversely of the frame with respect to said screen so as to provide variable magnetic attraction by selectively placing opposite magnetic poles in closer alignment to increase the pressure between said first and second magnetic means or selectively to decrease the pressure between said first and second magnetic means by placing the like magnetic poles in alignment.

13. A multi-head rotary screen printer according to claim 12 including position control means to change the position of the second magnetic means in relation to the first magnetic means to obtain a desired pressure between the second magnetic means and the screen printer roll.

14. A multi-head rotary screen printer according to claim 13 wherein each said end of each said printer head assembly comprises a rotary screen head, each end of each said screen printer roll being mounted in a respective rotary screen head said mounting being adjustable both vertically and horizontally with respect to said heads.

* * * * *